US010145113B2

(12) United States Patent
Houston et al.

(10) Patent No.: US 10,145,113 B2
(45) Date of Patent: Dec. 4, 2018

(54) STUD WELDABLE REBAR

(71) Applicant: Nelson Stud Welding, Inc., Elyria, OH (US)

(72) Inventors: Ian Houston, Avon Lake, OH (US); Clark Champney, Vermilion, OH (US); Jon Edgar, Brunswick, OH (US); Cornel Irimies, Marco Island, FL (US)

(73) Assignee: Nelson Stud Welding, Inc., Elyria, OH (US)

( * ) Notice: Subject to any disclaimer, the term of this patent is extended or adjusted under 35 U.S.C. 154(b) by 0 days.

(21) Appl. No.: 15/445,011

(22) Filed: Feb. 28, 2017

(65) Prior Publication Data

US 2017/0247884 A1 Aug. 31, 2017

Related U.S. Application Data

(60) Provisional application No. 62/300,986, filed on Feb. 29, 2016.

(51) Int. Cl.

| | |
|---|---|
| ***E04C 5/01*** | (2006.01) |
| ***C22C 38/00*** | (2006.01) |
| ***B21J 5/08*** | (2006.01) |
| ***E04C 5/12*** | (2006.01) |
| ***C22C 38/12*** | (2006.01) |
| ***C22C 38/06*** | (2006.01) |

(Continued)

(52) U.S. Cl.

CPC ..... *E04C 5/01* (2013.01); *B21J 5/08* (2013.01); *C22C 38/00* (2013.01); *C22C 38/002* (2013.01); *C22C 38/02* (2013.01); *C22C 38/04* (2013.01); *C22C 38/06* (2013.01); *C22C 38/12* (2013.01); *E04C 5/02* (2013.01); *E04C 5/125* (2013.01); *E04C 5/03* (2013.01)

(58) Field of Classification Search

CPC .. E04C 5/01; E04C 5/125; C22C 38/00; B21J 5/08

See application file for complete search history.

(56) References Cited

U.S. PATENT DOCUMENTS 5,152,118 A * 10/1992 Lancelot ..... E04C 5/125 52/848

5,776,001 A 7/1998 Carter (Continued)

OTHER PUBLICATIONS

International Search Report corresponding to PCT/US2017/019905 dated May 15, 2017.

*Primary Examiner* — Andrew J Triggs

(74) *Attorney, Agent, or Firm* — Dickinson Wright PLLC

(57) ABSTRACT

A stud weldable rebar includes a steel bar comprised of a material composition confirming to ASTM 706 which extends along an axis A from a first end to a second end. The steel bar includes a base portion disposed adjacent the first end which has a base diameter D1 to define a base cross-sectional area of the base portion. The steel bar also includes an upset portion disposed adjacent the second end which has an upset diameter D2 being greater than said base diameter D1 to define an upset cross-sectional area of said upset portion. The material composition of the steel bar is restricted to a carbon equivalency between 0.31 and 0.43, and the upset cross-sectional area is approximately 13.5% to 22.5% greater than the base cross-sectional area to provide A706 rebar that surprisingly meets both the AWS D1.1 and ACI 318 standards after stud welding.

17 Claims, 1 Drawing Sheet

(51) Int. Cl.

| | |
|---|---|
| ***C22C 38/04*** | (2006.01) |
| ***C22C 38/02*** | (2006.01) |
| ***E04C 5/02*** | (2006.01) |
| *E04C 5/03* | (2006.01) |

(56) References Cited

U.S. PATENT DOCUMENTS

| | | | | |
|---|---|---|---|---|
| 6,023,990 | A * | 2/2000 | Carr | F16H 55/06 29/893.37 |
| 2002/0189175 | A1* | 12/2002 | Lancelot, III | E04C 5/16 52/155 |
| 2014/0237935 | A1* | 8/2014 | Nissen | E04C 5/01 52/741.3 |
| 2014/0325815 | A1* | 11/2014 | Dahl | B21K 1/56 29/428 |
| 2017/0247884 | A1* | 8/2017 | Houston | E04C 5/01 |

* cited by examiner

STUD WELDABLE REBAR

CROSS-REFERENCE TO PRIOR APPLICATION

This non-provisional patent application claims the benefit of U.S. Provisional Patent Application Ser. No. 62/300,986 filed on Feb. 29, 2016, the entire disclosure of the application being considered part of the disclosure of this application and hereby incorporated by reference.

BACKGROUND OF THE INVENTION

This section provides a general summary of background information and the comments and examples provided in this section are not necessarily prior art to the present disclosure.

Concrete is a commonly-used construction material. Concrete is very strong in compression, but relatively weak in tension. Reinforcing steel, also known as "rebar," is a steel bar or mesh of steel wires used as a tension device in reinforced concrete and reinforced masonry structures to strengthen and hold the concrete in tension. Rebar is conventionally fabricated into round shapes for use in reinforced concrete and masonry.

Rebar must meet industry standards, such as ASTM International. A615/A615M-15 Standard for Deformed and Plain Carbon-Steel Bars for Concrete Reinforcement, and ASTM International A706/A706M-15 Standard Specification for Deformed and Plain Low-Alloy Steel Bars for Concrete Reinforcement (hereinafter "ASTM A706"), the contents of which are incorporated herein. Rebar used in construction as welded wire fabric or deformed bar anchor studs can alternatively meet ASTM A1064/A1064M-13 (hereinafter "ASTM A1064"). Rebar used in structures subject to certain potential seismic loading, a function of the anticipated intensity of ground shaking and other earthquake effects the structure is likely to experience and the structure's use, must meet the Structural Concrete Building Code, ACI 318-14 (hereinafter "ACT 318"), of the American Concrete Institute, the contents of which are incorporated herein in their entirety.

Rebar can be arc welded. Arc welding, however, is a relatively time-consuming process. Furthermore, if a metal having high carbon content such as rebar is cooled too quickly after arc welding, it gets extremely brittle and hard. Accordingly, arc welding of rebar often involves preheating the material as well as specialized welding equipment and accessories in order to slow cooling and reduce brittleness.

Another technique for fastening rebar to a base metal without the need for welding is to thread an end of the rebar. One such example is illustrated in FIG. 1 (not drawn to scale), in which a threadable rebar 10 includes a steel bar 12 which extends from a first end 14 to a second threaded end 16. A threaded aperture (not expressly shown) is correspondingly created in the base metal and the threaded end 16 of the rebar 10 is then threaded therein to fasten the threaded end 16 of the rebar 10 to the base metal. However, this technique requires specialized equipment and extra steps to manufacture both the threaded end 16 of the rebar 10 and the threaded aperture of the base metal as well as to assemble the threaded end 16 of the rebar 10 into the threaded aperture of the base metal.

Stud welding is a technique for welding a fastener such as a pin, stud or other fastener, to a base metal. The studs are welded to the base metal by establishing an electrical arc between the stud and the base metal to heat the metal at the tip of the stud and the base metal to a molten or liquid state and then plunging the stud into the base metal before the molten metal cools to solid state. Stud welding can be accomplished much more quickly than standard arc welding methods. However, stud welding must meet industry standards as well, such as American Welding Society Structural Welding Code Steel, AWS D1.1/D1.1M:2015 (23$^{rd}$ ed. Jul. 28, 2015) (hereinafter "AWS D1.1"), the contents of which are incorporated herein in their entirety. Additionally, studs must meet the ACI 318 standards if the stud is to be used in structures having certain potential seismic risk.

Rebar can in some instances be stud welded. For example, rebar which meets the dimensional and strength requirements of ASTM A1064 can be stud welded. However, studs made from ASTM A1064 rebar material do not meet the seismic requirements of ACI 318. Accordingly, ASTM A1064 rebar cannot be stud welded in construction applications having a certain level of seismic loading.

Thus, there remains a significant and continuing need for a stud weldable rebar that meet the AWS D1.1 industry standards for concrete construction as well as the ACI 318 standards for construction in seismic risk zones, without the need for pre-heat or specialized welding equipment, processes, or accessories.

SUMMARY OF THE INVENTION

The present invention is directed to a high-strength low-alloy steel bar for concrete reinforcement which meets the composition requirements of A706. The steel bar which meets the composition requirements of A706 extends along an axis A from a first end to a second end and includes a base portion disposed adjacent the first end which has a first diameter D1 to define a base cross-sectional area of the base portion of the steel bar. The steel bar also includes an upset portion disposed adjacent the second end which has a second diameter D2 being greater than the first diameter D1 to define an upset cross-sectional area of the upset portion of the steel bar being greater than the base cross-sectional area. The material composition of the steel bar is restricted to a carbon equivalency between 0.31 and 0.43 and the upset cross-sectional area is approximately 13.5-22.5% greater than the base cross-sectional area. Applicant has surprisingly found that A706 rebar which is restricted to this carbon equivalency and modified to establish this cross-sectional area relationship between the upset and base portions meet both the AWS D1.1 welding industry standards and the concrete code ACI 318 requirements after stud welding. In other words A706 rebar which is restricted to a carbon equivalency between 0.31 and 0.43 and manufactured to include an upset cross-sectional area that is approximately 13.5-22.5% greater than the base cross-sectional area surprisingly provides a stud weldable rebar product which meets all of the industry standards without the need for pre-heat or specialized welding equipment and accessories.

A BRIEF DESCRIPTION OF THE DRAWINGS

The drawings described herein are for illustrative purposes only of selected embodiments and not all possible implementations, and are not intended to limit the scope of the present disclosure.

Figure 1:
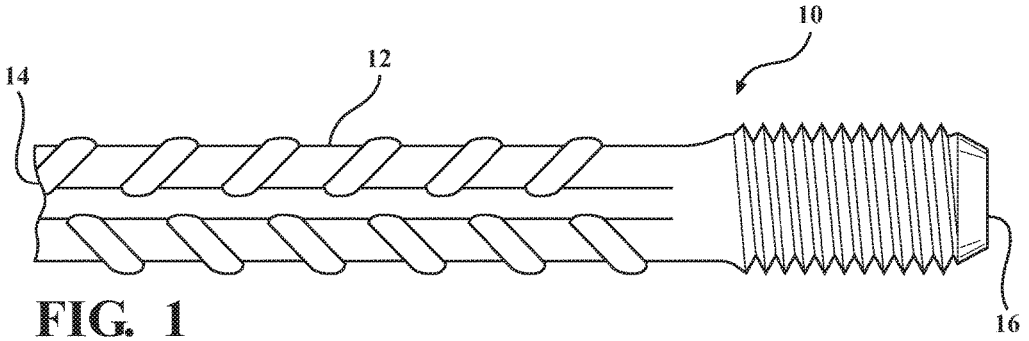
FIG. 1 PRIOR ART
FIG. 1 is a perspective side view of a prior art bar of threaded rebar.
Figure 2:
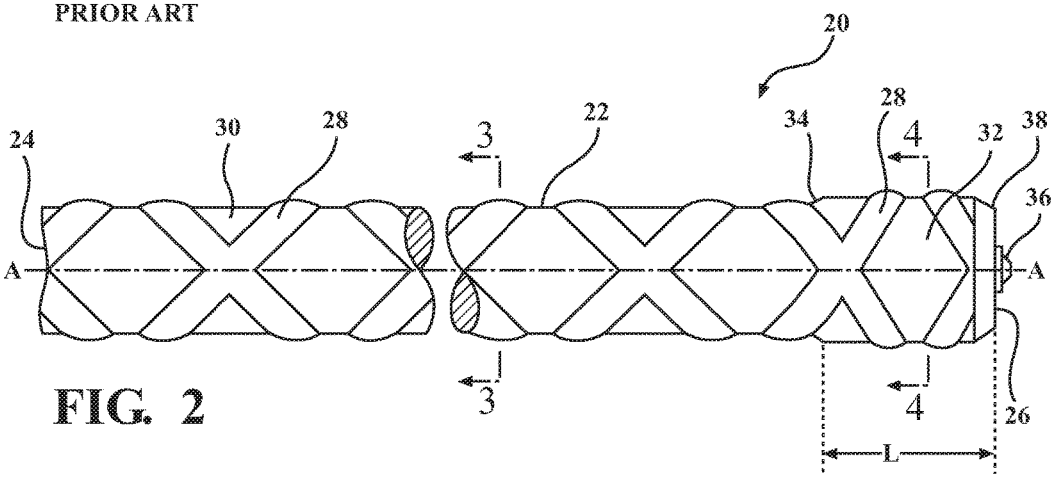
FIG. 2 is a perspective view of a steel bar according to the subject disclosure which extends from a first end to a second end along an axis A and includes a base portion disposed adjacent the first end and an upset portion disposed adjacent the second end.
Figure 3:
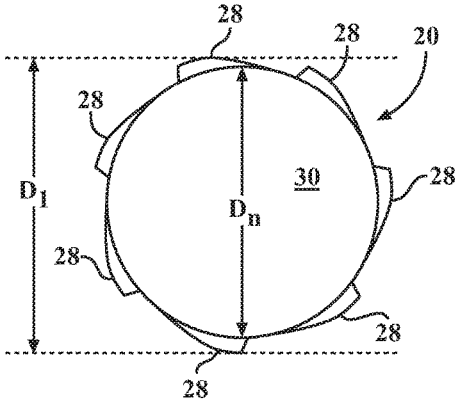
Figure 4:
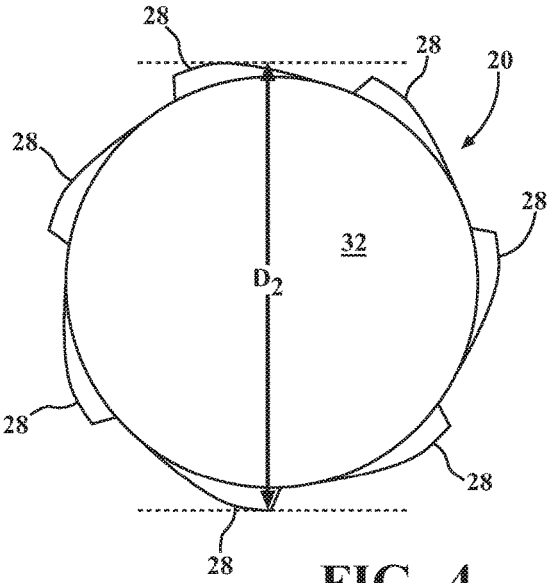

FIG. 3 is a cross-sectional view of the steel bar of FIG. 2 taken along 3-3 and illustrating a first diameter D1 of the base portion to define a base cross-sectional area of the steel bar; and FIG. 4 is a cross-sectional view of the bar of FIG. 2 taken along 4-4 and illustrating a second diameter D2 of the upset portion being greater than the first diameter D1 of the base portion to define an upset cross-sectional area of the steel bar being greater than the base cross-sectional area.

DETAILED DESCRIPTION OF THE ENABLING EMBODIMENTS

Example embodiments of a stud weldable rebar will now be more fully described. Each of these example embodiments are provided so that this disclosure is thorough and fully conveys the scope of the inventive concepts, features and advantages to those skilled in the art. To this end, numerous specific details are set forth such as examples of specific components, dimensions, and compositions to provide a thorough understanding of each of the embodiments associated with the present disclosure. However, as will be apparent to those skilled in the art, not all specific details described herein need to be employed, the example embodiments may be embodied in many different forms, and thus should not be construed or interpreted to limit the scope of the disclosure.

FIG. 2 is a perspective view of a stud weldable rebar 20 in accordance with an aspect of the subject disclosure. As best shown therein, the stud weldable rebar 20 includes a steel bar 22 of a generally cylindrical shape which extends along an axis A from a first end 24 to a second end 26. The steel bar 22 is comprised of a material composition which conforms to the requirements of ASTM 706. The steel bar 22 also conforms to the requirements for nominal weight, nominal diameter, perimeter, and deformation as also forth in ASTM 706. As is common in rebar, the steel bar 22 includes a plurality of deformations or ridges, such as inclined transverse ribs 28, which are disposed along the steel bar 22 between the first and second ends 24, 26.

As best illustrated in FIG. 2, the steel bar 20 includes a base portion 30 which is disposed adjacent the first end 22. As best illustrated in FIG. 3, the base portion 30 has a base diameter D1, measured transversely to the axis A and inclusive of both a nominal diameter $D_n$ of the steel bar 22 as well as the plurality of ribs 28. The base diameter D1 defines a base cross-sectional area of the base portion 20 according to the equation $(\pi*D1^2)/4$. As further illustrated in FIGS. 2 and 4, the steel bar 20 includes an upset portion 32 which is disposed adjacent the second end 22 and has an upset diameter D2, again measured transversely to the axis A, being greater than the base diameter D1. The upset diameter D2 defines an upset cross-sectional area of the upset portion 32 of the steel bar 22 according to the same equation, namely $(\pi*D2^2)/4$.

As best shown in FIG. 2, the steel bar 22 includes a transition portion 34 which is sloped radially inward, preferably at a 30 degree angle, from the upset portion 32 to the base portion 30. The upset portion 32 has a length L extending axially from the transition portion 34 to the second end 26 of the steel bar 22. The second end 26 can have a flat surface extending transversely to the axis A, such as illustrated in FIG. 2, or alternatively could be hemispherical in shape. A flux load, such as an aluminum ball 36, is pressed into second end 26 to act as flux for stud welding of the rebar 20. The upset portion 32 can also include a chamfer 38 disposed adjacent the second end 26 and which slopes radially inward towards the second end 26, such as a 30 or 45 degree angle, plus or minus 2 degrees. However, other angles of the chamfer 38 can be utilized without departing from the scope of the subject disclosure.

As set forth in the following table, the stud weldable rebar 20 includes an upset portion 32 having an upset cross-sectional area that is approximately 13.5% to 22.5% greater than the base cross-sectional area. Additionally, the stud weldable rebar 20 includes an upset portion 32 that has an upset diameter D2 approximately 6.5% to 10.5% greater than a base diameter D1 of the base portion 30.

TABLE 1

Preferred Dimensions of the Stud Weldable Rebar

| Nominal Bar Size | D1 (+/−0.005) | Cross-sectional area of D1 base portion ($in^2$) | D2 | L (+/−0.025) | Cross-sectional area of D2 upset portion ($in^2$) | Area increase base to upset | Increase D1 to D2 |
|---|---|---|---|---|---|---|---|
| 3/8 | 0.404" | 0.1282 | 0.431-0.441" | 0.456" | 0.1459-0.1527 | 13.81-19.16% | 6.7-9.2% |
| 1/2 | 0.539" | 0.2282 | 0.575-0.590" | 0.608" | 0.2597-0.2734 | 13.80-19.82% | 6.7-9.5% |
| 5/8 | 0.661" | 0.3432 | 0.707-0.727" | 0.747" | 0.3926-0.4151 | 14.40-20.97% | 7.0-10.0% |
| 3/4 | 0.825" | 0.5346 | 0.880-0.905" | 0.930" | 0.6082-0.6433 | 13.78-20.33% | 6.7-9.7% |
| 7/8 | 0.961" | 0.7253 | 1.025-1.060" | 1.083" | 0.8252-0.8825 | 13.76-21.66% | 6.7-10.3% |
| 1 | 1.098" | 0.9469 | 1.170-1.215" | 1.237 | 1.0751-1.1594 | 13.54-22.45% | 6.6-10.6% |

As previously mentioned, the steel bar 22 of the stud weldable rebar 20 conforms to the material composition requirements of ASTM A706. However, Applicant has surprisingly found that a steel bar 22 in accordance with more limiting composition ranges relative to the A706 composition requirements, in conjunction with the dimensional limitations provided immediately above in Table 1, provides for stud weldable A706 rebar that meets both the AWS D1.1 construction code industry standards as well as the seismic code ACT 318 requirements after stud welding. More specifically, steel bars that meet the chemical composition requirements of ASTM A706 can have a carbon equivalency ($C_{eq}$) of up to 0.55 percent, with the carbon equivalency calculated according to the following equation: $C_{eq}$=% C+% Mn/6+% Cu/40+% Ni/20+% Cr/10−% Mo/50−% V/10. However, a carbon equivalency of up to 0.55 percent is too high for stud welding. Applicant has surprisingly found that a steel bar 22 with a minimum carbon equivalent ($C_{eq}$) of 0.31 and a maximum carbon equivalent ($C_{eq}$) of 0.43, in conjunction with the dimensional limitations set forth in Table 1, provides for stud weldable A706 rebar. The following Table provides for the preferred material compositions of the steel bar 22 which provides a more limiting A706 composition that meets this carbon equivalency ($C_{eq}$) range of 0.31 to 0.43.

TABLE 2

Preferred Material Compositions of the Stud Weldable Rebar

| Element | Preferred range in percent by weight | More preferable range in percent by weight | Most preferable range in percent by weight |
|---|---|---|---|
| Carbon (C) | 0.080-0.330 | 0.080-0.230 | 0.080-0.210 |
| Manganese (Mn) | 0.001-1.56 | 0.30-1.20 | 1.00-1.20 |
| Phosphorus (P) | 0.043 max | 0.040 max | 0.030 max |
| Sulfur (S) | 0.053 max | 0.050 max | 0.030 max |
| Silicon (Si) | 0.001-0.550 | 0.200-0.40 | 0.200-0.30 |
| Copper (Cu) | 0.250 max | 0.250 max | 0.250 max |
| Nickel (Ni) | 0.150 max | 0.150 max | 0.150 max |
| Chromium (Cr) | 0.150 max | 0.150 max | 0.150 max |
| Molybdenum (Mo) | 0.001-0.050 | 0.001-0.050 | 0.001-0.040 |
| Aluminum (Al)[A] | 0.001-0.060 | 0.001-0.020 | 0.001-0.015 |
| Vanadium (V) | 0.001-0.080 | 0.030-0.080 | 0.060-0.080 |
| Boron (B) | 0.0005 max | 0.0005 max | 0.0005 max |
| Nitrogen (N) | 0.020 max | 0.020 max | 0.020 max |

[A]Aluminum minimum sufficient to bind nitrogen.

A method of manufacturing a stud weldable rebar includes obtaining a steel bar 22 having a base diameter D1 extending from a first end 24 to a second end 26 and a material composition which confirms to the requirements of ASTM 706 but with a restricted chemical composition, such as the preferred compositions provided in Table 2 above, to provide a carbon equivalency ($C_{eq}$) of the steel bar 22 between 0.31 and 0.43. The method proceeds by upsetting the second end 26 of the steel bar 22 to create an upset portion 32 disposed adjacent the second end 26 having an upset diameter D2 being greater than the base diameter D1 to define an upset cross-sectional area of the upset portion 32. The upset cross-sectional area is preferably 13.5% to 22.5% greater than a base cross-sectional area of the base portion 30 to provide an A706 rebar 20 that meets both the AWS D1.1 construction code industry standards as well as the seismic code ACI 318 requirements after stud welding. The step of upsetting the second end 26 of the steel bar 22 also preferably includes upsetting the second end 26 of the steel bar 22 to establish the upset diameter D2 to approximately 6.5% to 10.5% greater than the base diameter D1. The step of upsetting the second end 26 of the steel bar also preferably includes establishing a transition zone 34 extending between the base and upset portions 30, 32, with the transition portion 34 preferably sloped radially inward at a 30 degree angle from the upset portion 32 to the base portion 30. The step of upsetting the second end 26 of the steel bar 22 also includes establishing a length L of the upset portion 32 which extends axially from the transition portion 34 to the second end 26. The preferred dimensions of the base diameter D1, the upset diameter D2, the length L, as well as the relationship between the base cross-sectional area of the base portion 30 and the upset cross-sectional area of the upset portion 32 is set forth in Table 2 above. Once the rebar 20 is manufactured, the second end 26 of the steel bar 22 can be stud welded to a base metal to meet the aforementioned industry standards.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A stud weldable rebar comprising:

a steel bar extending along an axis A from a first end to a second end and comprised of a material composition having:

0.080-0.330 wt. % of carbon;

0.001-1.56 wt. % of manganese;

less than 0.043 wt. % of phosphorus;

less than 0.053 wt. % of sulfur;

0.001-0.550 wt. % of silicon;

0.001-0.050 wt. % of molybdenum;

0.001-0.060 wt. % of aluminum; and 0.001-0.080 wt. % of vanadium;

said steel bar including a base portion disposed adjacent said first end having a base diameter D1 to define a base cross-sectional area of said base portion of said steel bar;

said steel bar including an upset portion disposed adjacent said second end;

said upset portion being unthreaded and having an upset diameter D2 being greater than said base diameter D1 to define an upset cross-sectional area of said upset portion of said steel bar being greater than said base cross-sectional area;

said material composition of said steel bar having a carbon equivalency between 0.31 and 0.43; and said upset cross-sectional area being approximately 13.5% to 22.5% greater than said base cross-sectional area.

2. A stud weldable rebar as set forth in claim 1 wherein said upset diameter D2 is approximately 6.5% to 10.5% greater than said base diameter D1.

3. A stud weldable rebar as set forth in claim 2, wherein said steel bar includes a transition portion which slopes radially inward from said upset portion to said base portion, and said upset portion has a length L extending axially from said transition portion to said second end.

4. A stud weldable rebar set forth in claim 3, wherein said base diameter D1 is approximately 0.399 to 0.409 inches and said upset diameter D2 is approximately 0.431 to 0.441 inches.

5. A stud weldable rebar as set forth in claim 4, wherein said length L of said upset portion is approximately 0.431 to 0.481 inches.

6. A stud weldable rebar as set forth in claim 3, wherein said base diameter D1 is approximately 0.534 to 0.544 inches and said upset diameter D2 is approximately 0.575 to 0.590 inches.

7. A stud weldable rebar as set forth in claim 6, wherein said length of said upset portion is approximately 0.583 to 0.633 inches.

8. A stud weldable rebar as set forth in claim 3, wherein said base diameter D1 is approximately 0.656 to 0.666 inches and said upset diameter D2 is approximately 0.707 to 0.727 inches.

9. A stud weldable rebar as set forth in claim 8, wherein said length L of said upset portion is approximately 0.725 to 0.772 inches.

10. A stud weldable rebar as set forth in claim 3, wherein said base diameter D1 is approximately 0.820 to 0.830 inches and said upset diameter D2 is approximately 0.880 to 0.905 inches.

11. A stud weldable rebar as set forth in claim 10, wherein said length L of said upset portion is approximately 0.905 to 0.955 inches.

12. A stud weldable rebar as set forth in claim 3, wherein said base diameter D1 is approximately 0.956 to 0.966 inches and said upset diameter D2 is approximately 1.025 to 1.060 inches.

13. A stud weldable rebar as set forth in claim 12, wherein said length L of said upset portion is approximately 1.058 to 1.108 inches.

14. A stud weldable rebar as set forth in claim 3, wherein said base diameter D1 is approximately 1.093 to 1.103 inches and said upset diameter D2 is approximately 1.170 to 1.215 inches.

15. A stud weldable rebar as set forth in claim 14, wherein said length L of said upset portion is approximately 1.212 to 1.262 inches.

16. A stud weldable rebar as set forth in claim 1, wherein said material composition of said steel bar is comprised of the following:

0.080-0.230 wt. % of carbon;
0.30-1.20 wt. % of manganese;
less than 0.040 wt. % of phosphorus;
less than 0.050 wt. % of sulfur;
0.20-0.40 wt. % of silicon;
0.001-0.020 wt. % of aluminum;
and 0.030-0.080 wt. % of vanadium.

17. A stud weldable rebar as set forth in claim 16, wherein said material composition of said steel bar is comprised of the following:

0.080-0.210 wt. % of carbon;
0-1.20 wt. % of manganese;
less than 0.030 wt. % of phosphorus;
less than 0.030 wt. % of sulfur;
0.20-0.30 wt. % of silicon;
0.001-0.040 wt. % of molybdenum;
0.001-0.015 wt. % of aluminum; and
0.060-0.080 wt. % of vanadium.

* * * * *